US006314749B1

(12) United States Patent
Van Steenburgh, Jr.

(10) Patent No.: US 6,314,749 B1
(45) Date of Patent: Nov. 13, 2001

(54) SELF-CLEARING VACUUM PUMP WITH EXTERNAL COOLING FOR EVACUATING REFRIGERANT STORAGE DEVICES AND SYSTEMS

(76) Inventor: Leon R. Van Steenburgh, Jr., 850 E. Lane Devils Gulch Route, Estes Park, CO (US) 80517

( * ) Notice: Subject to any disclaimer, the term of this patent is extended or adjusted under 35 U.S.C. 154(b) by 0 days.

(21) Appl. No.: 09/498,493

(22) Filed: Feb. 3, 2000

(51) Int. Cl.[7] ..... F25B 45/00; F04B 17/00

(52) U.S. Cl. ..... 62/292; 62/77; 62/149; 417/423.8; 417/372

(58) Field of Search ..... 62/292, 149, 77, 62/475, 474, 85, 195, 470; 417/355, 201, 423.8, 366, 372; 418/83, 101

(56) References Cited

U.S. PATENT DOCUMENTS

| | | | | |
|---|---|---|---|---|
| 4,363,222 | | 12/1982 | Cain | 62/292 |
| 4,476,688 | | 10/1984 | Goddard | 629/149 |
| 4,646,527 | | 3/1987 | Taylor | 62/85 |
| 4,805,416 | | 2/1989 | Manz et al. | 62/292 |
| 4,967,570 | | 11/1990 | Van Steenburgh | 62/292 |
| 5,020,331 | | 6/1991 | Michny | 62/77 |
| 5,038,853 | * | 8/1991 | Callaway, Sr. et al. | 417/366 X |
| 5,115,645 | | 5/1992 | Abraham | 62/292 |
| 5,138,847 | | 8/1992 | Rollins | 62/292 |
| 5,146,761 | | 9/1992 | Cavanaugh | 62/149 |
| 5,189,881 | | 3/1993 | Miles | 62/77 |
| 5,230,224 | | 7/1993 | Ricketts et al. | 629/292 |
| 5,277,032 | | 1/1994 | See et al. | 62/125 |
| 5,303,559 | | 4/1994 | Sevrain et al. | 62/77 |
| 5,325,675 | | 7/1994 | Manz et al. | 62/77 |
| 5,332,369 | * | 7/1994 | Jensen | 417/423.8 X |
| 5,375,425 | | 12/1994 | Cobb | 62/77 |
| 5,535,596 | | 7/1996 | Todack | 62/85 |
| 5,616,973 | * | 4/1997 | Khazanov et al. . | |
| 5,638,689 | | 6/1997 | Scaringe et al. | 62/77 |
| 5,653,125 | * | 8/1997 | Boyanich | 417/372 X |
| 5,678,415 | | 10/1997 | Peckjian et al. | 62/149 |
| 5,772,410 | * | 6/1998 | Chang | 417/372 X |
| 5,857,842 | * | 1/1999 | Sheehan | 417/372 X |
| 5,971,725 | * | 10/1999 | De Simon | 417/423.8 |
| 6,016,661 | | 1/2000 | Sager | 62/149 |
| 6,121,698 | * | 9/2000 | Sexton | 417/423.8 X |

FOREIGN PATENT DOCUMENTS

| | | | |
|---|---|---|---|
| 4021-254-A | 4/1990 | (DE) . | |
| 3-28676(A) | 2/1989 | (JP) | F25B/45/00 |
| 4-20760(A) | 5/1990 | (JP) | F25B/45/00 |
| 88/07654 | 10/1988 | (WO) | F25B/45/00 |
| 89/07227 | 10/1989 | (WO) | F25B/45/00 |
| 92/02771 | 2/1992 | (WO) | F25B/45/00 |
| 92/16802 | 10/1992 | (WO) | F25B/45/00 |

* cited by examiner

*Primary Examiner*—Henry Bennett
*Assistant Examiner*—Chen-Wen Jiang
(74) *Attorney, Agent, or Firm*—Thomas C. Folsom; Chrisman Bynum & Johnson

(57) ABSTRACT

A method and system for fully evacuating refrigerant from storage devices, appliances, and refrigerant systems. An evacuation system is provided with a vacuum pump including a housing containing an electric motor positioned with its stator in heat conductive contact with the inner surfaces of the housing. The electric motor is used to drive a rotating-vane, rotary compressor that provides positive displacement suction on the device being evacuated of refrigerant. The vacuum pump further includes an external cooling system positioned about the housing to dissipate heat that builds up within the housing during periods of low refrigerant flow. The external cooling system includes tubular fins contained within a shell and held in abutting contact with an outer surface of the housing and a fan for forcing cooling air flow over and through the fins. During operation, the external cooling allows the motor and compressor to be used to obtain deep vacuums of 15 inches mercury vacuum and more within the device being evacuated.

25 Claims, 10 Drawing Sheets

SELF-CLEARING VACUUM PUMP WITH EXTERNAL COOLING FOR EVACUATING REFRIGERANT STORAGE DEVICES AND SYSTEMS

BACKGROUND OF THE INVENTION

1. Field of the Invention

The present invention relates generally to a method and apparatus for evacuating refrigerant from a storage device or an appliance or system containing refrigerant, and more particularly, to a method and apparatus including a self-clearing, vacuum pump with external, forced-air cooling that can operate with a positive inlet and/or outlet pressure and is adapted for obtaining a deep vacuum to completely evacuate refrigerant from an appliance, refrigerant system, or storage device.

2. Description of the Related Art

The Clean Air Act was enacted in 1990 and is enforced by the Environmental Protection Agency (EPA) which has passed a number of regulations to limit and regulate the use of refrigerants to limit the harmful effects of atmospheric ozone depletion by chlorine-based refrigerants. Significantly, the EPA regulations make it illegal to intentionally discharge or vent refrigerants into the atmosphere and require EPA certification of equipment used for recovery, reclaiming, and recycling of refrigerants (i.e., the three standard processes used to remove refrigerant from a system or storage device and to clean the removed refrigerant). This has resulted in a demand for equipment or machines for recovering, recycling, and reclaiming refrigerant that meet the EPA requirements. In general, recycling machines are used to remove a refrigerant from an appliance or storage container and to clean the refrigerant for reuse, typically by passing the refrigerant through an oil separator to remove contaminated oil and through devices that at least partially reduce moisture, acidity, and particulate matter. In contrast, reclaiming machines are more complex devices used to process refrigerant to the purity specified in American Refrigeration Institute standards, i.e., the reclaimed refrigerant typically needs to be clean or cleaner than new refrigerant. In general, recovery machines are devices used to remove refrigerant in any condition from an appliance or storage container and to transfer or pump the removed refrigerant to another container for storage without further processing.

In an attempt to control the discharge of refrigerant to the atmosphere, the EPA established minimum levels of evacuation to be met when recovery, recycling, and reclaiming machines are used to evacuate refrigerant from appliances and storage containers, i.e., a level of evacuation that leaves relatively small amounts of refrigerant in the appliance or container which can then be vented or discharged to the atmosphere. For example, the EPA has established the following evacuation levels for high-pressure appliances, as measured in inches of mercury (Hg) vacuum (relative to standard atmospheric pressure of 29.9 inches mercury (Hg)): (1) 0 inches for HCFC-22 appliances containing less than 200 pounds (liquid weight of refrigerant); (2) 10 inches for HCFC-22 appliances containing more than 200 pounds; (3) 10 inches for CFC-12, CFC-500, CFC-502, and CFC-114 appliances containing less than 200 pounds; and (4) 15 inches for CFC-12, CFC-500, CFC-502, and CFC-114 appliances containing more than 200 pounds. For the purposes of this patent, any vacuum level below about 3 to 4 inches Hg, and more particularly, below about 10 inches Hg, is considered a "deep vacuum." Unfortunately, while providing an easily measured standard for evacuation, the EPA evacuation levels, especially the deep vacuum levels, have proven difficult to obtain using existing equipment.

In practice, a technician who wants to remove refrigerant from an appliance or storage device, to complete maintenance, clean the refrigerant, or otherwise, will connect the appliance or storage device to a recovery, recycling, or reclaiming device that draws the refrigerant out with its compressor. These devices may also include a condenser to change the refrigerant discharged from the compressor to a liquid for ease of storage in a cylinder or tank and may also include a heat exchanger located upstream of the compressor to allow evacuation of liquid refrigerant without causing damage to the compressor. By far, the most commonly used compressors in these devices are hermetic, reciprocating piston compressors in which the motor is sealed in the same housing as the compressor and is positioned within an external shell on internally mounted springs. A gap is left between the external shell and the motor to allow the motor to be isolated from compressor vibrations. In these types of compressors, the bottom portion of the external shell acts as an oil sump, and as the oil circulates and lubricates the internal moving parts, it picks up some of the compressor heat caused by friction of the moving parts, work performed during compression, and electric motor inefficiencies and transfers this heat to the external shell. To prevent overheating problems in these "low-side dome" compressors, the refrigerant that is suctioned, preferably at an inlet pressure of about 5 p.s.i.g. or greater, into the compressor is drawn through the motor windings and around the motor in the gap between the motor and external shell before it is taken into the compressor cylinder(s) to remove some of the heat developed by the motor from the compressor.

Because heat removal is almost completely dependent on the mass flow of refrigerant over the motor, the spring-mounted, reciprocating compressor can be ineffective in many circumstances in achieving the minimum evacuation levels (specifically, 10 or more inches Hg) required by the EPA. These compressors typically overheat prior to reaching the required evacuation levels because of the significant reduction in refrigerant flow, and the compressor either automatically trips off or simply "bums out." For example, when a recovery, recycling, or reclaiming machine with this type of compressor is used to evacuate a storage tank (e.g., a typical refrigerant storage tank has an internal volume of about 130 cubic feet), a technician connects the machine to the storage tank and operates the machine's compressor (e.g., a fractional horsepower, reciprocating compressor) to draw the refrigerant out for storage and/or processing. Although the evacuation of the storage tank progresses quickly when the tank is relatively full, e.g., charged at higher pressures, the process slows dramatically as the pressure in the storage tank is lowered from about 15 p.s.i.g. to atmospheric pressure (0 inches Hg) and slows even more as a vacuum is developed in the storage tank. The compressor operates below the refrigerant inlet pressure needed for adequate cooling until the compressor overheats, typically when 0 to 4 inches Hg vacuum or even no vacuum has been obtained on the storage tank. In this regard, U.S. Pat. No. 4,998,416 of Van Steenburgh, Jr. provides a reclaiming machine that injects small amounts of liquid refrigerant onto the motor coils when minimal amounts of refrigerant are entering the compressor inlet. However, even with this improved compressor cooling system, the compressor components begin to heat up rapidly at suction inlet pressures of about 5 to 15 p.s.i.g., which can result in compressor failure prior to obtaining a deep vacuum on the device being evacuated.

Because existing equipment and compressors are ineffective in achieving the EPA set evacuation levels, many technicians in the industry will only utilize the compressor of the recovery, recycling, or reclaiming machine to remove as much refrigerant as possible, which generally achieves a vacuum of 0 to 4 inches Hg in the evacuated device. During this operation, the technician may attempt to avoid damaging the compressor by monitoring the temperature of the compressor and manually shutting the machine off when the compressor begins to overheat. The technician will then connect a standard refrigerant vacuum pump to the device being evacuated to remove more of the refrigerant by drawing a vacuum and discharging the removed refrigerant to the atmosphere. As can be appreciated by those in the art, the standard vacuum pump typically will only operate with an inlet pressure of 0 p.s.i.g. or vacuum and an outlet pressure equal to atmospheric pressure or less, and the vacuum pumps generally employed are able to draw a vacuum of about 29.9 inches Hg at sea level as it discharges refrigerant to the atmosphere. At this level of vacuum, the device is considered by the technician to be "empty."

The inventor recognizes that due to the limitations of existing refrigerant equipment a technician may have problems fully and easily complying with the EPA regulations under a number of operating conditions. These problems in complying with the regulations can result in a significant amount of refrigerant being discharged to the atmosphere in violation of the premises of the Clean Air Act. In the above storage tank example, the following approximate weights of various types of refrigerant would be pumped into the atmosphere (assuming the vacuum pump was connected when 0 p.s.i.g. was obtained in the storage tank): 42 pounds of R-12, 30 pounds of R-22, 35 pounds of R-500, and 38 pounds of R-502. This is a significant discharge of refrigerant when it is understood that this magnitude of discharge occurs throughout the refrigerant industry each time refrigerant is evacuated from a storage tank and similarly, smaller amounts of refrigerant are discharged each time an appliance or smaller storage device is evacuated. Consequently, there is a strong environmental and legal need for an apparatus and method for more effectively evacuating refrigerant storage devices, appliances, and systems to meet the EPA minimum evacuation levels. Additionally, such a system would provide significant economic benefits by more fully capturing refrigerant which continues to increase in price and by reducing equipment costs by eliminating the need for repairing and replacing compressors.

Additionally, the inventor recognizes that even when the EPA's minimum evacuation levels are obtained, the storage device, appliance, or system will still contain a residual amount of refrigerant, i.e., not be fully empty. Although the residual amount is not as large as the amount removed between 0 and 15 inches Hg vacuum, it is believed to be a large enough amount to make it economically desirable to capture the residual amount of refrigerant. This additional evacuation step also provides a more fully evacuated storage device, appliance, or system which may reduce possible discharges to the atmosphere and reduce maintenance problems that may arise from mixing of refrigerant and oils if a different refrigerant is charged into the storage device, appliance, or system. Consequently, it is desirable to provide an apparatus and method for providing additional evacuation of refrigerant devices to remove at least a portion of residual refrigerant remaining after EPA evacuation levels are achieved.

SUMMARY OF THE INVENTION

To address the above discussed needs and regulatory constraints, the present invention is directed to a self-clearing, refrigerant vacuum pump assembly that is configured for fully evacuating a refrigerant storage container or refrigerant system (e.g., a refrigerant device). Generally, according to the invention, the vacuum pump assembly can be connected directly to an outlet of the refrigerant device and then operated to evacuate refrigerant from the device down to evacuation levels of 10 to 15 inches of Hg vacuum to satisfy existing EPA standards. Additionally, the unique features of the vacuum pump assembly enable the vacuum pump assembly to evacuate refrigerant devices to evacuation levels of nearly 30 inches Hg vacuum, thereby complying with the goal of the Clean Air Act of zero discharge of chlorine-based refrigerants to the atmosphere. In contrast to vacuum pumps available before the invention, the vacuum pump assembly of the invention can tolerate a positive inlet pressure and/or a positive outlet pressure. These features of the vacuum pump assembly allow a technician to simply connect the vacuum pump assembly to a refrigerant device under pressure and pump removed refrigerant directly into a storage container (rather than discharging to atmosphere as is typically done with standard vacuum pumps). There is no need for first evacuating the refrigerant device to atmospheric pressure or slight vacuum prior to connecting the vacuum pump of the invention, thereby simplifying evacuation operations and reducing costs for equipment and labor.

According to one aspect of the invention, the vacuum pump assembly includes a refrigerant compressor unit with an external cooling system to allow operation of the first refrigerant compressor unit even at low mass flow rates of refrigerant. The first refrigerant compressor unit includes a sealable housing fabricated from a thermally conductive material. A compressor is positioned within the housing and is driven by an electric motor also positioned within the housing. A number of positive displacement compressors, such as a reciprocating compressor, can be successfully employed in the invention to allow the vacuum pump assembly to be connected to a positive inlet pressure and to pump against a positive outlet pressure. In a preferred embodiment, a rotary compressor, such as a rotating-vane rotary compressor, has proven especially useful for obtaining a deep vacuum and for pumping against positive outlet pressure. The electric motor is preferably press fit or otherwise positioned within the housing such that a significant portion of the electric motor is contacting an internal surface of the housing. For example, in one embodiment, the motor stator is in abutting contact with the inner surface of the housing to provide a relatively large heat transfer surface and path from the electric motor. Heat developed by the electric motor is removed by refrigerant discharged from the compressor flowing over the windings and rotor and, significantly, is also removed as it flows from the stator through the housing from the inner surface to an outer surface of the housing. In this regard, the external cooling system functions to supplement heat removal from the housing during periods of low flow of refrigerant. Low flow (e.g., below design specifications for most refrigerant compressors) occurs at an inlet pressure of about 3 to 4 p.s.i.g. or less and certainly when the compressor is being used to obtain a deep vacuum on a refrigerant device being evacuated and very little cooling is available from refrigerant flow, which is when commonly used reciprocating, low side dome compressors shutdown or lock up due to overheating.

The external cooling system functions to effectively dissipate or remove heat that reaches the outer surface of the housing. As can be appreciated, a large number of configurations of cooling devices and systems can be used to remove the heat, such as a system that causes liquids or fluids in one or more channels to flow across the outer surface or a heat exchanger device that places cooling coils (filled with refrigerant or other lower temperature fluids) around the housing in contact with the outer surface. In one embodiment, the external cooling system includes a heat transfer element positioned about the periphery of the housing and in heat-conductive contact with the external surface. The heat transfer element provides an extended heat transfer surface for the housing that increases the heat transfer rate. To further increase the heat transfer rate, the external cooling system includes a fan to force a cooling gas (e.g., air) to flow through the heat transfer element and quickly remove heat that builds up on surfaces of the heat transfer element. The heat transfer element includes a plurality of fins fabricated from a thermally conductive material that contact the outer surface of the housing and extend outward from the housing to provide an extended heat transfer surface. The fins also act to channel the gas flowing through the fan. A large number of shapes and sizes of fins can be used in the invention such as straight fins, tube fins (of a number of shapes including, but not limited to, round, oval, polygonal, and flat tubes), and other fin shapes that will be apparent to those skilled in the heat transfer arts. In one embodiment, the fins are round copper tubes having a diameter ranging from about ½-inch to 4 inches. The tubes are mechanically banded to the housing to avoid damaging the stator and to provide contact with the outer surface of the housing and with adjacent tubes (e.g., fins). An outer shell can also be included that encloses the fins and further channels the cooling gas moved by the fan into contact with the inner and outer surfaces of the fins (e.g., the cooling gas flows through the tubes, in gaps between the tubes and the outer surface of the housing, and in gaps between the tubes and the outer shell) to improve the efficiency of heat transfer between the fins and the cooling gas to control the size of fan that is required. With the external cooling system operating to remove heat, the first refrigerant compressor can be beneficially operated to obtain deep vacuum on a refrigerant device even with low flow of refrigerant over the compressor's driving motor.

According to another aspect of the invention, the vacuum pump assembly includes a number of other features or components that enhance reliable operation of the first refrigerant compressor. A suction accumulator is included between the refrigerant device being evacuated and the first refrigerant compressor inlet to capture any liquid refrigerant being removed from the refrigerant device and to vaporize the refrigerant, thereby minimizing the risk of liquid hammer damage to the first refrigerant compressor. The suction accumulator is further configured with an oil return orifice in its discharge conduit such that oil accumulating in the liquid refrigerant is injected into the vaporized refrigerant to provide adequate lubrication of the first refrigerant compressor. To further enhance proper lubrication of the first refrigerant compressor, an oil separator is included in the discharge conduit of the first refrigerant compressor to remove oil from the gaseous refrigerant discharged from the first refrigerant compressor. Lubrication can be a concern because during operations at deep vacuum inlet pressure, the pressure differential between the compressor inlet and the outlet of the housing causes the oil to leak by the compressor into the gaseous refrigerant. An oil return conduit is provided to transfer captured oil from the oil separator to the suction accumulator where it is injected into vaporized refrigerant through the oil return orifice.

According to yet another aspect of the invention, the vacuum pump assembly can optionally be configured to provide self-clearing of refrigerant remaining at or near the end of evacuation by the first refrigerant compressor. As discussed previously, it is often desirable to completely or nearly completely empty (e.g., clear) the components and conduits of refrigerant machines prior to subsequent uses and prior to this invention this was accomplished with a separate vacuum pump or simply venting any remaining refrigerant to atmosphere. To provide a self-clearing feature, the vacuum pump includes a second refrigerant compressor in fluid communication with a refrigerant discharge conduit from the oil separator. The second refrigerant compressor is operated to pump any refrigerant remaining in the housing and the oil separator as well as any communicating conduits. An inlet valve and pressure regulator can be used to control refrigerant flow into the second compressor, and check valves can be positioned in the discharge conduits of each of the compressors to prevent unwanted back flow of refrigerant into the vacuum pump.

According to still another aspect of the invention, the vacuum pump assembly can readily be combined with other refrigerant removal and processing machines and storage containers to create a number of useful refrigerant evacuation systems. In one embodiment, an evacuation system is provided that includes a refrigerant device to be evacuated with the vacuum pump assembly in fluid communication with an outlet of the refrigerant device. The vacuum pump assembly is used to pump refrigerant from the refrigerant device directly into a refrigerant storage container. As with other evacuation systems, it should be noted that both the inlet and the outlet of the vacuum pump can be at a positive pressure without damaging the vacuum pump assembly. In another embodiment, an evacuation system is provided that includes a refrigerant device to be evacuated connected to the vacuum pump assembly which is in fluid communication with a refrigerant condenser. At the outlet of the refrigerant condenser, a storage container is included to receive and store liquid refrigerant. In yet another embodiment, the outlet of the vacuum pump assembly is connected to a recovery, a recycling, or a reclaim machine which may be any of a number of existing machines, such as those produced by Van Steenburgh Engineering Labs, Inc., Estes Park, Colo. These machines can be used to process the refrigerant and then place the refrigerant in a storage container or pump it back into the refrigerant device.

Other features and advantages of the invention will become clear from the following detailed description and drawings of particular embodiments of the vacuum pump assembly and associated combinations and systems of the present invention.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE INVENTION

Figure 1:
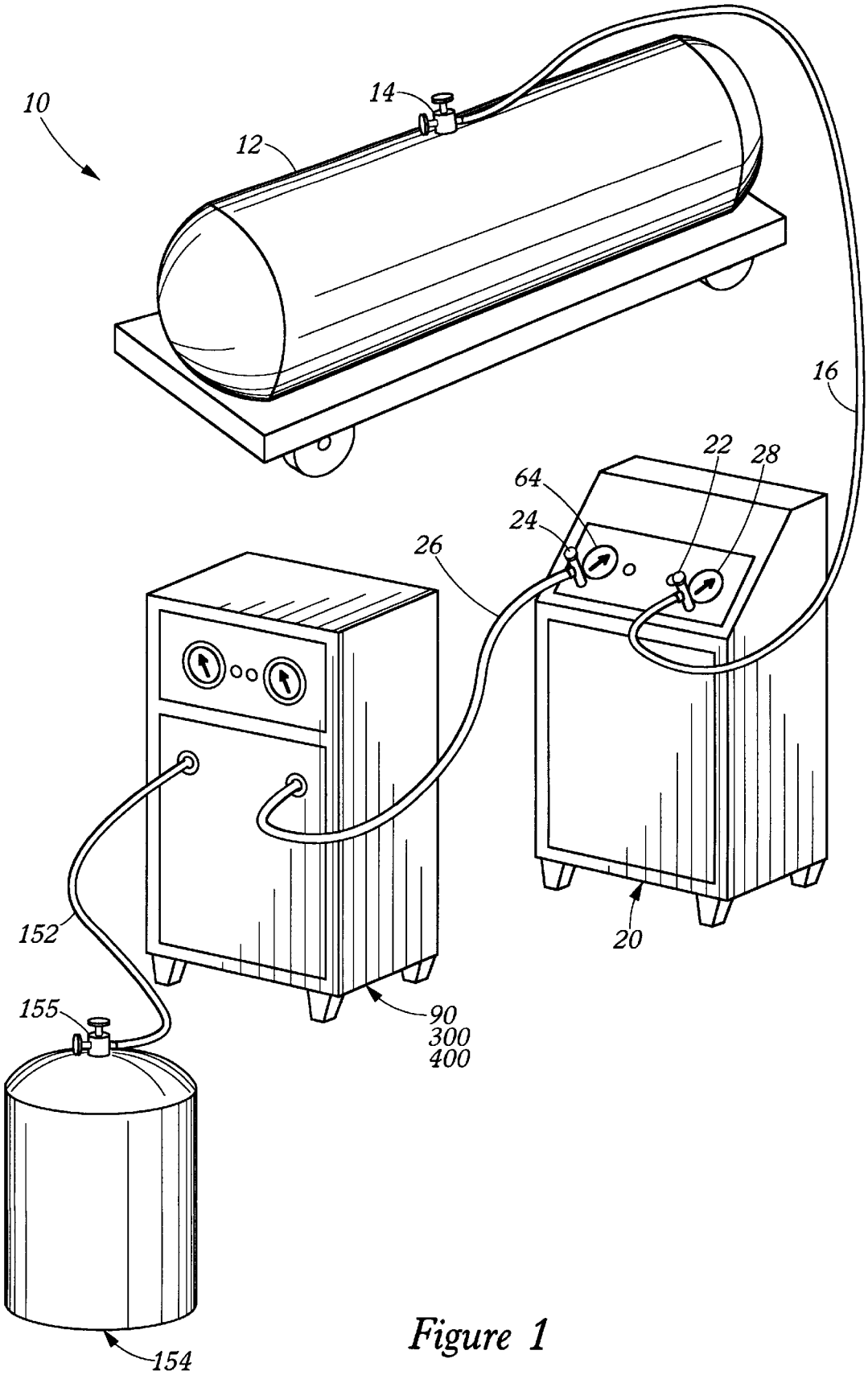
FIG. 1 is a perspective view of a refrigerant evacuation system of the present invention.

With the above summary in mind, it may now be helpful in fully understanding the inventive features of the present invention to provide in the following description a thorough and detailed discussion of a number of specific embodiments of the invention. Specifically, the following discussion emphasizes the features of a vacuum pump according to the invention that provides a method and system for evacuating any type of device containing refrigerant to a desired evacuation level, such as the levels of 4, 10 and 15 or more inches of Hg vacuum discussed previously. The discussion of the invention will progress from a full description of an evacuation system that includes the inventive vacuum pump and a reclaim or a recycling machine to the specific features of the vacuum pump that allow its use even during extended periods of low mass flow of refrigerant. The discussion will then proceed to a number of other evacuation systems that utilize the vacuum pump of the present invention and close with a discussion of a method of evacuating a device containing refrigerant according to the present invention.

FIGS. 1, 2, and 3A–3C depict an evacuation system 10 that generally includes a storage tank 12 (e.g., a refrigerant containing device to be evacuated), a refrigerant vacuum pump 20, a refrigerant reclaim machine 90 (see FIG. 3C) and 300 (see FIG. 3A) or a recycling machine 400 (see FIG. 3B) and a refrigerant storage device 154. A suction conduit 16 is connected to an outlet 14 of the storage tank 12 and to an inlet 22 of the vacuum pump 20 to provide a flow path for refrigerant evacuated from the storage tank 12. A vacuum pump discharge conduit 26 is connected to an outlet 24 of the vacuum pump 20 and to an inlet 92 of the reclaim machine 90, 300 or recycling machine 400. The outlet of the reclaim machine 90, 300 or recycling machine 400 is connected to an outlet conduit 152 to provide a refrigerant flow path to refrigerant storage device 154 via inlet 155.

Figure 2:
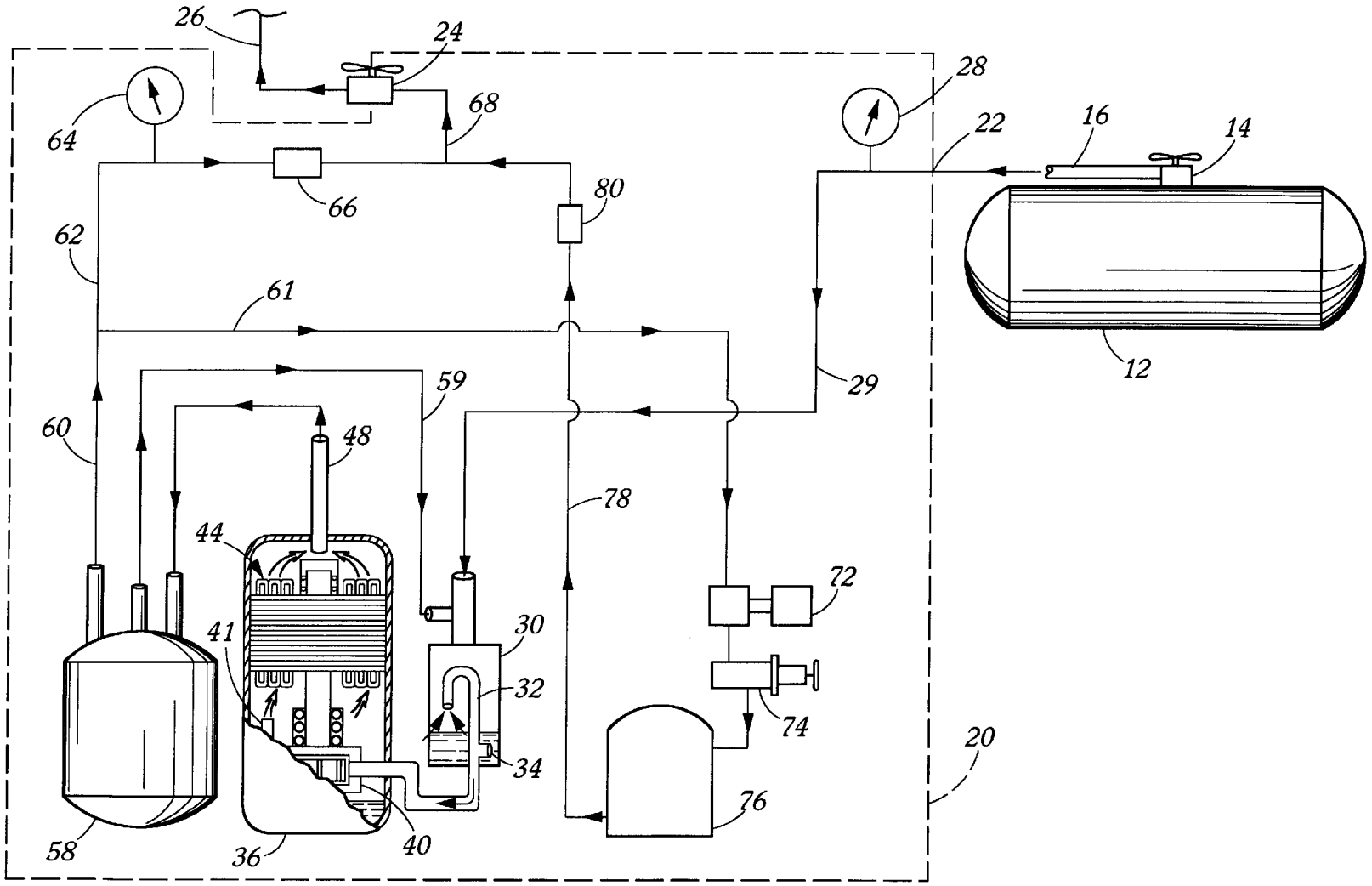
FIG. 2 is a partial schematic illustration of the refrigerant evacuation system of FIG. 1 showing the storage tank and the refrigerant vacuum pump of the refrigerant evacuation system.

Turning to FIG. 2, refrigerant evacuated from storage tank 12 (which although shown as a storage tank can be any device containing refrigerant) flows through outlet 14 through suction conduit 16 to the inlet 22 of the refrigerant vacuum pump 20. An inlet suction line pressure gauge 28 is provided for measuring inlet pressure of the refrigerant vacuum pump 20 which also indicates the vacuum drawn on the storage tank 12. This pressure gauge preferably has a range of at least 30 inches Hg vacuum to about 30 p.s.i.g. positive pressure because, as discussed previously, the refrigerant pump is designed to operate with positive inlet pressures and for obtaining a deep vacuum reaching about 29.9 inches Hg vacuum at sea level. The evacuated refrigerant then flows in accumulator conduit 29 into the top of suction accumulator 30. In the suction accumulator 30, any liquid refrigerant is collected in the bottom of the suction accumulator 30 and allowed to vaporize prior to entering into compressor inlet conduit 32 (e.g., the refrigerant inlet to housing 36), thereby preventing liquid to enter compressor 40 which is designed only to pump gaseous refrigerant.

Gaseous refrigerant flows through the compressor inlet conduit 32 into sealable housing 36 (e.g., shell providing hermetic sealing of interior components) where it is drawn into refrigerant compressor 40. Although a number of positive displacement compressors can be utilized in the invention, the compressor 40 is preferably a rotating-vane rotary compressor to provide efficient, positive displacement of refrigerant even at low mass flow rates to achieve a deeper vacuum than may be possible with other types of compressors. The compressor 40 pumps the refrigerant into the housing 36 through compressor outlet 41 at which point the gaseous refrigerant flows over and through the electric motor 44, providing cooling of the electric motor 44. As will become clear from later discussion of the inventive external cooling system 50 of FIG. 6, this cooling action is only effective for maintaining a desirable operating temperature for the electric motor 44 when refrigerant mass flow is relatively high, i.e., only during the initial evacuation of storage device 12, and without further cooling the electric motor 44 would overheat.

The refrigerant then flows out of the housing 36 through conduit 48 which in fluid communication with oil separator 58. The oil separator 58 functions to remove oil from the gaseous refrigerant which may leak by the compressor 40 due to existing pressure differentials within the housing 36. Separated oil is captured within the oil separator 58 and flows out of the oil separator 58 through oil return conduit 59 which is in fluid communication with the suction accumulator 30. The returned oil enters the top of the suction accumulator 30 and accumulates in the bottom of the suction accumulator 30 where it commingles with liquid refrigerant and also where it is drawn into the compressor inlet conduit 32 through oil return orifice 34 for injection into gaseous refrigerant, thereby providing adequate lubrication for the vanes of the compressor 40.

Gaseous refrigerant exits the oil separator 58 through refrigerant discharge conduit 60 which branches into second refrigerant compressor inlet conduit 61 and into outlet conduit 62. During normal evacuation operations, the compressor 40 provides the suction forces to evacuate the storage tank 12, and refrigerant flows from the oil separator 58 through refrigerant discharge conduit 60 into outlet conduit 62 for discharge from the vacuum pump 20. An outlet pressure gauge 64 is provided in outlet conduit 62 to measure the pressure of the outlet of the vacuum pump 20. Additionally, a check valve 66 is provided to prevent back flow of refrigerant into the oil separator 58 and housing 36, which is especially important during operation of the second refrigerant compressor 76. After passing through the check valve 66, the refrigerant flows into outlet conduit 68 and through outlet 24 which can be a control valve (e.g., a ball valve, a solenoid valve, or any other standard valve). The refrigerant is blocked from flowing into the second refrigerant compressor 76 by check valve 80. The evacuated refrigerant is discharged from the vacuum pump 20 in pump discharge conduit 26 through outlet 24.

When evacuation is completed (i.e., a predetermined evacuation level is measured on suction pressure gauge 28, such as 4 to about 29.9 inches Hg vacuum at sea level), the second refrigerant compressor 76 can be beneficially operated to clear or evacuate the vacuum pump 20 of refrigerant, e.g., provide a self-clearing feature. In this mode of operation, refrigerant from outlet conduit 62 and refrigerant discharge conduit 60 (and upstream components including the oil separator 58, the housing 36, suction accumulator 30, and accumulator inlet conduit 29) is evacuated and flows into second refrigerant compressor inlet conduit 61. The refrigerant then flows through solenoid 72, which can be automatically opened and closed with operation of the second refrigerant compressor 76, and pressure regulator 74, which can be set at any number of desired pressure settings such as, for example, 45 p.s.i.g. The refrigerant is then drawn into the second refrigerant compressor 76 which pumps the refrigerant into discharge conduit 78 and through check valve 80 and out of the vacuum pump 20, as discussed above. The self-clearing operation is a relatively quick operation which minimizes risk of overheating the second refrigerant compressor 76, which may be a standard spring-mounted, low-side dome compressor that requires refrigerant flow for cooling. Although a quick operation, the self-clearing feature removes substantially all the refrigerant remaining in the vacuum pump 20 after evacuation operations, thereby eliminating the need for an additional step of connecting a standard vacuum pump and venting any remaining refrigerant to atmosphere.

With this general understanding of the components of the evacuation system 10 understood, a more detailed description of a number of reclaim and recycling machines will be discussed in detail to provide a fuller understanding of the numerous configurations that can be employed with the vacuum pump 20 of the present invention. It will be understood that although specific reclaim and recycling machines are described in detail, a wide variety of other embodiments could be utilized and will be apparent to those in the refrigerant industry. For example, a reclaim device such as that described in U.S. Pat. No. 4,998,416 of Van Steenburgh, Jr. is included in one embodiment (not shown) of the evacuation system according to the invention, and a number of reclaim machines manufactured by the industry can also be used in the evacuation system, such as, but not limited to, Model Numbers BV300, JV90, LV30, CV15, and RV10 from Van Steenburgh Engineering Laboratories, Inc., Estes Park, Colo. Further, other refrigerant processing devices, such as standard recovery machines (e.g., Model Number RVJR from Van Steenburgh Engineering Laboratories, Inc., Estes Park, Colo. may readily be substituted for the described recycling and reclaim machines.

Figure 3A:
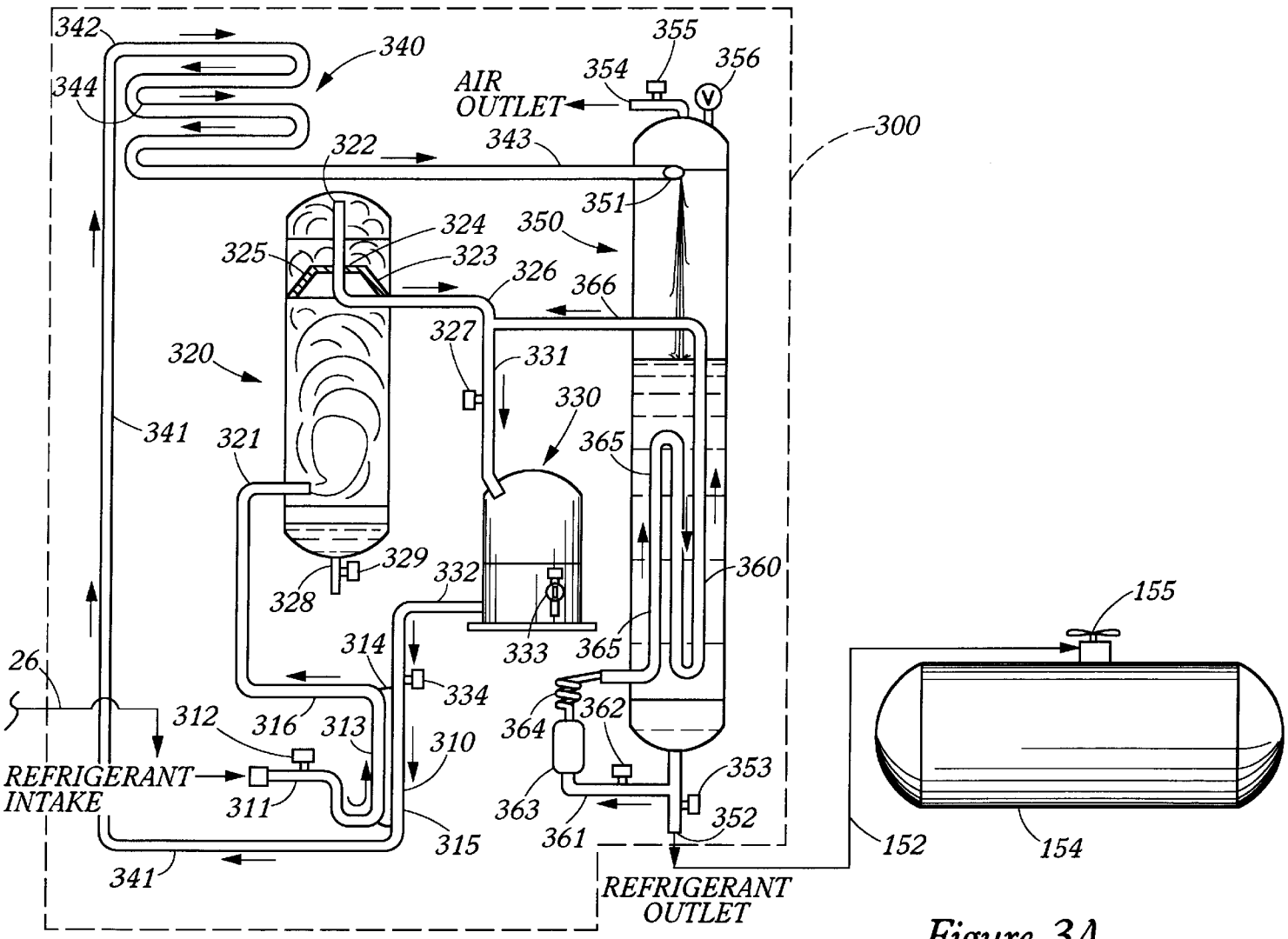
FIG. 3A is a partial schematic illustration of the refrigerant evacuation system of FIG. 1 including one embodiment of a refrigerant reclaim machine that can be used in the refrigerant evacuation system and the refrigerant storage cylinder/tank.

Turning to FIG. 3A, one embodiment of a reclaim machine 300 is illustrated that can be used in the evacuation system 10, and is flurther described in U.S. Pat. No. 5,357,768 of Van Steenburgh, Jr. which is incorporated herein by reference. In this embodiment, refrigerant discharged from the vacuum pump 20 flows through vacuum pump discharge conduit 26 and enters the reclaim machine 300 at the intake fluid conduit 311 in which flow is controlled by valve 312. The refrigerant then flows to the conduit 313 which constitutes the cold side of heat exchanger 310 and is connected to the hot side conduit 315 by weld 314. Conduit 316 is the outlet from the cold side of the heat exchanger 310 and directs the refrigerant to the oil separator 320 through the conduit 321. Another fluid conduit 322 has its open end fixed near the inner surface of the rounded top of the oil separator 320 and also supports a circular baffle 323 composed of a disc-like portion 324 and a downwardly extending cone-shaped skirt 325. Conduit 322 is connected to fluid conduits 326 and 331 controlled by a low pressure activated electrical control device 327 having a pressure gauge indicator associated with it. The control device 327 will automatically shut down compressor 330 when the pressure in conduit 331 drops to virtually 0 p.s.i.g. Oil from the bottom of oil separator 320 can be discharged through fluid conduit 328 controlled by valve 329.

Fluid conduit 331 extends through the outer wall of compressor 330, which is provided with a fluid conduit outlet 332 and an oil sight gauge and oil supply device 333. Outlet conduit 332 has a high pressure activated electrical control device 334 associated with it and is in fluid communication with conduit 315 of heat exchanger 310 which leads into conduit 341. Conduit 341 provides a flow path to condenser 340 through condenser inlet conduit 342. If pressure in conduit 332 is too high, control device 334 acts automatically to shut down compressor 330. Outlet conduit 343 connects the condenser 340 to the chill tank 350 through outlet 351. At the bottom of the chill tank 350 there is an outlet fluid conduit 352 controlled by valve 353. At the upper end of the chill tank 350 there is an air outlet conduit 354 controlled by valve 355. Conduit 354 is vented to the atmosphere through a small orifice to prevent an explosive discharge of air. Also located at the upper end of the chill tank 350 is a high pressure activated safety valve 356.

Located partially within and partially outside chill tank 350 is a cooling and recycling system 360 composed of a conduit 361 in fluid communication with conduit 352 and controlled by valve 362. The conduit 361 directs flow to filter-drier 363, which in turn is connected to expansion device 364. The expansion device 364 is connected to conduit 365 arranged in the form of a coil within the chill tank 350. The cooling coil 365 directs refrigerant to conduit 366 within connects with inlet conduit 331 of compressor 330. Of course, all the elements of the reclaim machine 300 can be readily mounted within a mobile cabinet having a control panel. To discharge refrigerant from the reclaim machine 300, valve 353 is operated to allow refrigerant to pass through conduit 352 through outlet conduit 152 into refrigerant storage device 154 through storage inlet control valve 155.

Figure 3B:
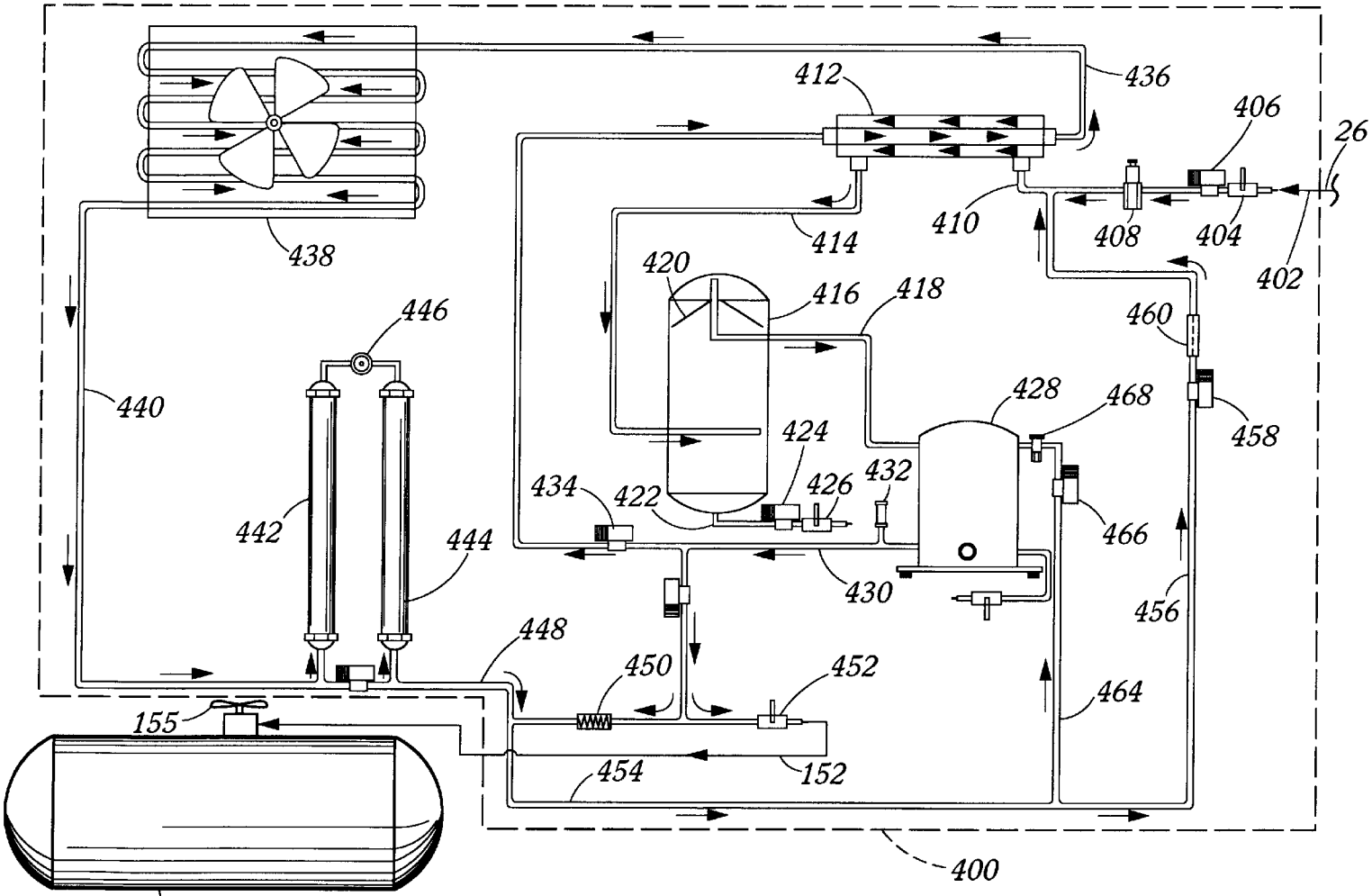
FIG. 3B is a partial schematic illustration of the refrigerant evacuation system of FIG. 1 including an embodiment of a recycling machine that can be used in the refrigerant evacuation system and the refrigerant storage cylinder/tank.

Turning now to FIG. 3B, an embodiment of a recycling machine 400 is illustrated that can be used in the evacuation system 10. In this embodiment, refrigerant discharged from the vacuum pump 20 flows through vacuum pump discharge conduit 26 and enters the recycling machine 400 at the intake fluid conduit 402 in which flow is controlled by inlet valve 404, solenoid valve 406 which is a float solenoid for safety shut off when full, and regulating valve 408 for controlling maximum high pressure. The refrigerant then flows to the conduit 410 which constitutes the cold side of heat exchanger 412. Conduit 414 is the outlet from the cold side of heat exchanger 412 and directs refrigerant into oil separator 416. Refrigerant exits the oil separator 416 through conduit 418 which has its open end fixed near the inner surface of the rounded top of the oil separator 416.

Conduit 418 also serves as a support for a circular baffle 420 (which may have many configurations such as a disc-like portion and a downwardly extending partially cone-shaped skirt). A copper line 422 with a solenoid valve 424 and a hand valve 426 is attached to the bottom of oil separator 416 to drain the oil and/or other contaminants.

Refrigerant discharged from the oil separator 416 flows through conduit 418 to compressor 428. Compressor 428 is provided with outlet conduit 430 and a safety blow off valve 432 (e.g., discharges when pressure is too high, such as above 375 to 400 p.s.i.g.). Outlet conduit 430 includes a high pressure activated recycle solenoid 434. Conduit 430 leads into the hot side of heat exchanger 412 which in turn discharges refrigerant into conduit 436 that directs refrigerant into condenser 438. Condenser outlet conduit 440 connects condenser 438 with storage tank 154, by way of a filtering path through a pair of filter driers 442, 444. Condenser outlet conduit 440 directs refrigerant into filter drier 442, through a moisture indicator 446, and then through second filter drier 444. The refrigerant then flows through conduit 448 toward the storage tank 154 through check valve 450 and outlet valve 452. The refrigerant in the storage tank 154 can be further processed to provide additional processing as necessary and/or a storage tank or cylinder may be used to provide temporary storage for refrigerant that is being recycled prior to discharging the refrigerant to the storage tank 154. Of course, the storage tank 154 can be positioned between the vacuum pump 20 and the recycling machine 400, and the recycling machine 400 can be operated to recycle the refrigerant in the storage tank 154.

According to another aspect, a liquid injection pathway is provided by including a liquid injection branch conduit 456 off of conduit 454 which provides refrigerant to solenoid valve 466 and liquid injection valve 468. These valves 466 and 468 control injection of liquid refrigerant into the compressor 428 for controlled cooling motor windings of the compressor 428 during long periods of pulling refrigerant vapor. Additionally, a pump out pathway is provided from the compressor 428 to the storage tank 154 for pumping out the recycle machine 400. This is achieved by drawing refrigerant from conduit 454 into conduit 456 by operating solenoid valve 458, with an orifice 460 being included to control or reduce refrigerant flow to the heat exchanger 412 to maintain efficiency.

Figure 3C:
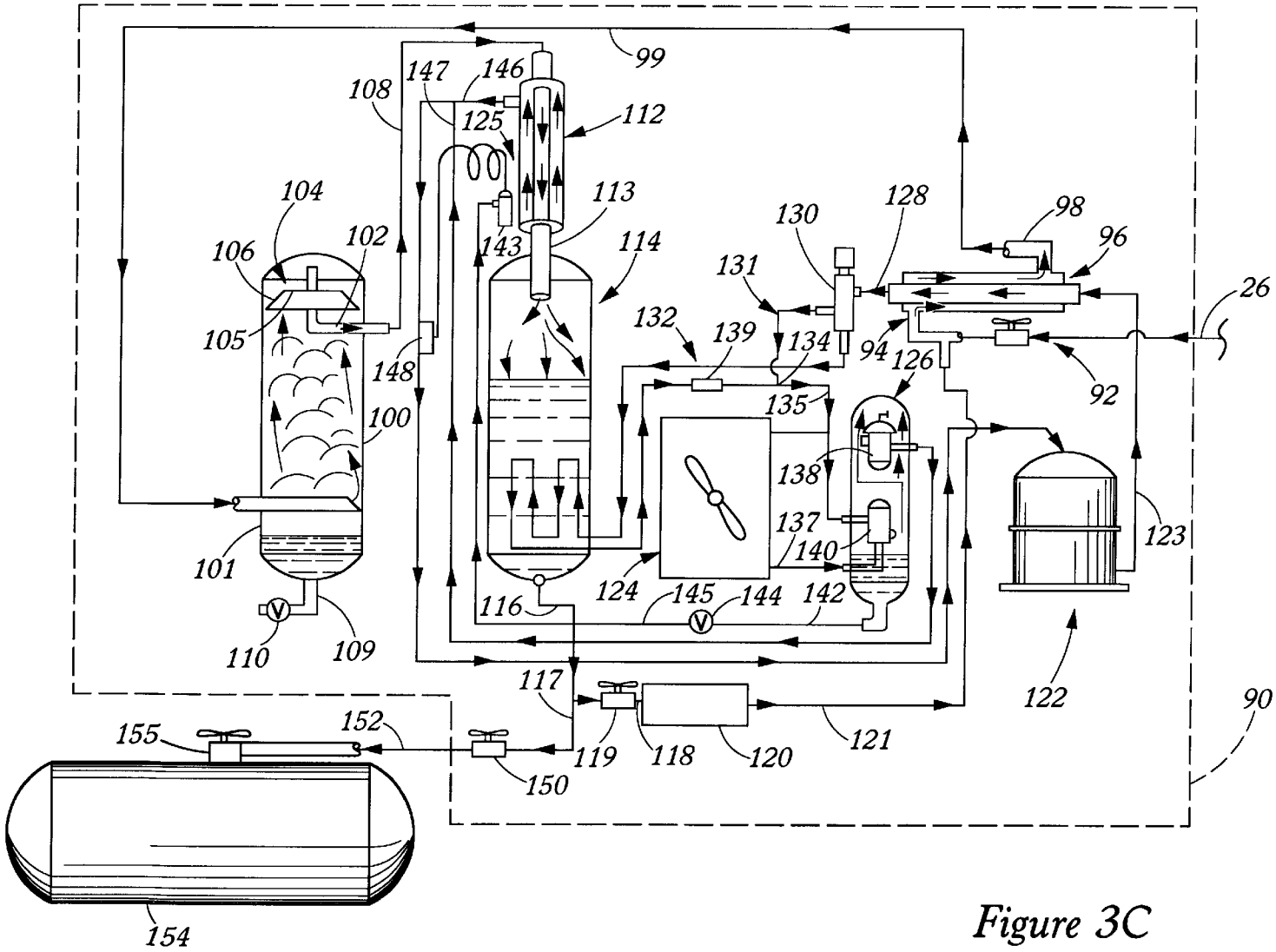
FIG. 3C is a partial schematic illustration of the refrigerant evacuation system of FIG. 1 including another embodiment of a refrigerant reclaim machine that can be used in the refrigerant evacuation system and the refrigerant storage cylinder/tank.

In an alternate embodiment, a reclaim machine 90 is utilized in the evacuation system 10 rather than the reclaim machine 300 and is illustrated in part in FIG. 3C and described in detail in U.S. Pat. No. 5,245,840 of Van Steenburgh, Jr., which is incorporated herein by reference. In this embodiment, refrigerant discharged from the vacuum pump 20 during the above procedures flows through vacuum pump discharge conduit 26 and enters the reclaim machine 90 at refrigerant inlet 92. The inlet 92 is in fluid communication with conduit 94, which is, in turn, in fluid communication with the cold side of first heat exchange element 96. Conduit 94 is in fluid communication with a conduit with spiral fins, or a ridge and groove arrangement, facilitating its being mounted within a conduit to form a so-called tube-within-a-tube heat exchanger. Preferably the tube-within-a-tube construction is in the form of a coil so as to provide greater length in a smaller space. Conduit 98 constitutes the outlet from the cold side of the first heat exchange element 96, and is in fluid communication with the oil separation chamber 100 through conduit 99. The oil separation chamber 100 is an elongated pressure cylinder with partially spherical ends mounted so that its longitudinal axis extends vertically. The fluid conduit 99 extends through the outer wall 101 of the oil separation chamber 100 in the bottom half of the cylinder.

Another fluid conduit 102 has its open end fixed near the inner surface of the rounded top of the cylinder. This fluid conduit 102 extends downwardly and supports a circular baffle 104 composed of a disc-like portion 105 and a downward-extending, partially cone-shaped skirt 106. Conduit 102 is arranged to extend along the axis of the cylinder and is connected to conduit 108 exiting the oil separation chamber 100. Oil from the bottom of oil separation chamber 100 can be discharged through fluid conduit 109, controlled by valve 110.

Fluid conduit 108 is in fluid communication with the hot side of second heat exchange element 112. Conduit 113 exits the hot side of the second heat exchange element 112. The second heat exchange element 112 is also a tube-within-a-tube heat exchanger as described above. Conduit 113 enters into and is in fluid communication with the interior of refrigerant storage cylinder 114. The refrigerant storage cylinder 114 is illustrated in FIG. 3C as an elongated, cylindrical pressure tank arranged with its longitudinal axis extending vertically and having upper and lower ends of partially spherical shape. The second heat exchange element 112 is located physically above the refrigerant storage cylinder 114.

Conduit 116 exits out of and is in fluid communication with the interior of the refrigerant storage cylinder 114. As described above for the inlet 92, the outlet conduit 117 may include solenoid valve means or manual valve means 150 for opening the outlet to allow refrigerant to exit the reclaim machine 90. Also in fluid communication with outlet conduit 117 is fluid conduit 118. Access into fluid conduit 118 is controlled by recycle valve 119. When valve 119 is open, conduit 118 is in fluid communication with drier unit 120. Such drier unit 120 may be any one of a number of widely-used, commercially available refrigerant driers. The exit of drier unit 120 is in fluid communication with the cold side of first heat exchange element 96 via conduit 121.

In addition to the above described refrigerant pathway (the secondary pathway), FIG. 3C also depicts a primary refrigerant pathway that is a closed system and does not commingle with refrigerant being reclaimed in the secondary pathway. The primary refrigeration pathway includes a compressor 122, a condenser 124, an evaporator 125, and a receiver 126. Conduit 123 exits and in fluid communication with the outlet of refrigerant compressor 122. Conduit 123 is also in fluid communication with the inlet of the hot side of first heat exchange element 96. Conduit 128 is in fluid communication with the outlet of the hot side of first heat exchange element 96. Conduit 128 is also in fluid communication with 3-way valve 130. 3-way valve 130 is designed to allow conduit 128 to be in fluid communication with either, but not both, fluid conduit 131 or 132. 3-way valve 130 may be solenoid operated or controlled by physical manipulation. Conduit 131 extends into the bottom portion of refrigerant storage cylinder 114, forms a coil within the cylinder and exits the cylinder. The contents of conduit 131 are not in fluid communication with, but are in thermal conductive relationship with, the contents of the storage cylinder 114. Conduit 131, after it exits the storage cylinder 114, and conduit 132 merge at a t-joint 134 which is in fluid communication with conduit 135. Conduit 131, after exiting the storage cylinder 114 and before the t-joint 134, contains a check valve 139 which will prevent flow of refrigerant towards the storage cylinder 114.

Conduit 135 is in fluid communication with the entrance to air condenser 124, and condenser bypass valve 140, which is located within the interior of receiver 126. Condenser 124 may be equipped with a fan to increase cooling of the contents of the condenser 124. The exit of condenser 124 is in fluid communication with conduit 137. Conduit 137 enters into the interior of receiver 126 and is in fluid communication with condenser bypass valve 140. Also located within receiver 126 is evaporator bypass valve 138. Conduit 142 is in fluid communication wit the interior of the receiver 126 and is connected to the receiver 126 near its bottom. Conduit 142 is in fluid communication with thermal expansion valve 143. At some point in conduit 142, outside of the receiver 126, is located a first flow restriction valve 144. The flow restriction valve 144 is preferably a solenoid-controlled valve. Conduit 145 is in fluid communication with the exit of the thermal expansion valve 143 and the cold side of second heat exchange element 112. Together, the thermal expansion valve 143 and the cold side of the second heat exchange element 112 are referenced to herein as the evaporator 125 of the primary refrigeration pathway.

Conduit 146 is in fluid communication with the exit of the cold side of the second heat exchange element 112 and the inlet to refrigerant compressor 122. Conduit 147, which is associated with evaporator bypass valve 138, exits through the receiver 126 wall and is in fluid communication with conduit 146. The thermal expansion valve 143 is controlled generally according to the temperature of the refrigerant in the outlet conduit 146 from the evaporator 125, by means of a thermostat 148 secured to the outlet conduit 146 and controlling a valve operator on the thermal expansion valve 143. Under certain pressure/temperature conditions, condenser bypass valve 140 directs the flow of refrigerant from conduit 135 directly to the receiver 126, bypassing condenser 124. In addition, evaporator bypass valve 138 allows gaseous refrigerant at a high temperature and pressure to flow directly to conduit 146, bypassing at least the thermal expansion valve 143 when the temperature and pressure in the evaporator are below a predetermined level.

Condenser bypass valve 140 is a three-way valve for supplying refrigerant to the receiver 126, either from the condenser 124 or form the compressor 122 bypassing the condenser 124.

When the pressure in the receiver 126 is low, the valve 140 shifts to provide for the flow of gaseous refrigerant at a relatively high temperature and pressure directly into the receiver 126. The receiver pressure can drop, for example, when the surrounding temperature falls to a sufficiently low level or the amount of liquid in the receiver 126 drops to an undesirably low level, thereby causing the receiver pressure to drop sufficiently below the required operating pressure for the refrigerant thermal expansion valve 143. Discharge of hot pressurized gas directly into the receiver 126 serves to pressurize the receiver 126 back to normal operating pressure and 1523 temperature. When the pressure in the receiver is increased, the condenser bypass valve 140 no longer acts to bypass the condenser 124, and refrigerant exiting the hot side of first heat exchange element 96 goes to 3-way valve 130. The 3-way valve 130 can be set to either direct the gaseous refrigerant directly to the condenser 124 via conduit 131, or indirectly via conduit 132. Refrigerant will be directed through conduit 132 when it is desirable to raise the temperature of the contents of the refrigerant storage cylinder 114.

The evaporator bypass valve 138 is utilized to supply hot gas directly from the compressor 122 to a point beyond the thermal expansion valve 143 during low load conditions, in order to allow efficient operation of the evaporator 125. The evaporator bypass valve 138 operates in the same manner as the condenser bypass valve 140 described above, and is also contained within the receiver 126. The evaporator bypass valve 138, when open, allows hot, compressed refrigerant gas from the receiver 126 to flow to a point downstream from the thermal expansion valve 143.

To discharge refrigerant from the refrigerant storage cylinder 114 after reclaim operations, 3-way valve 130 is repositioned to allow hot gaseous refrigerant to pass through conduit 132 and to raise the temperature within the refrigerant storage cylinder 114. The refrigerant storage device 154 is connected to the outlet control valve 150 of the reclaim machine 90 with reclaim machine outlet conduit 152. Then, outlet control valve 150 is opened to allow the reclaimed refrigerant to flow through conduit 117 and reclaim machine outlet conduit 152 into refrigerant storage device 154 through inlet control valve 155.

Figure 4:
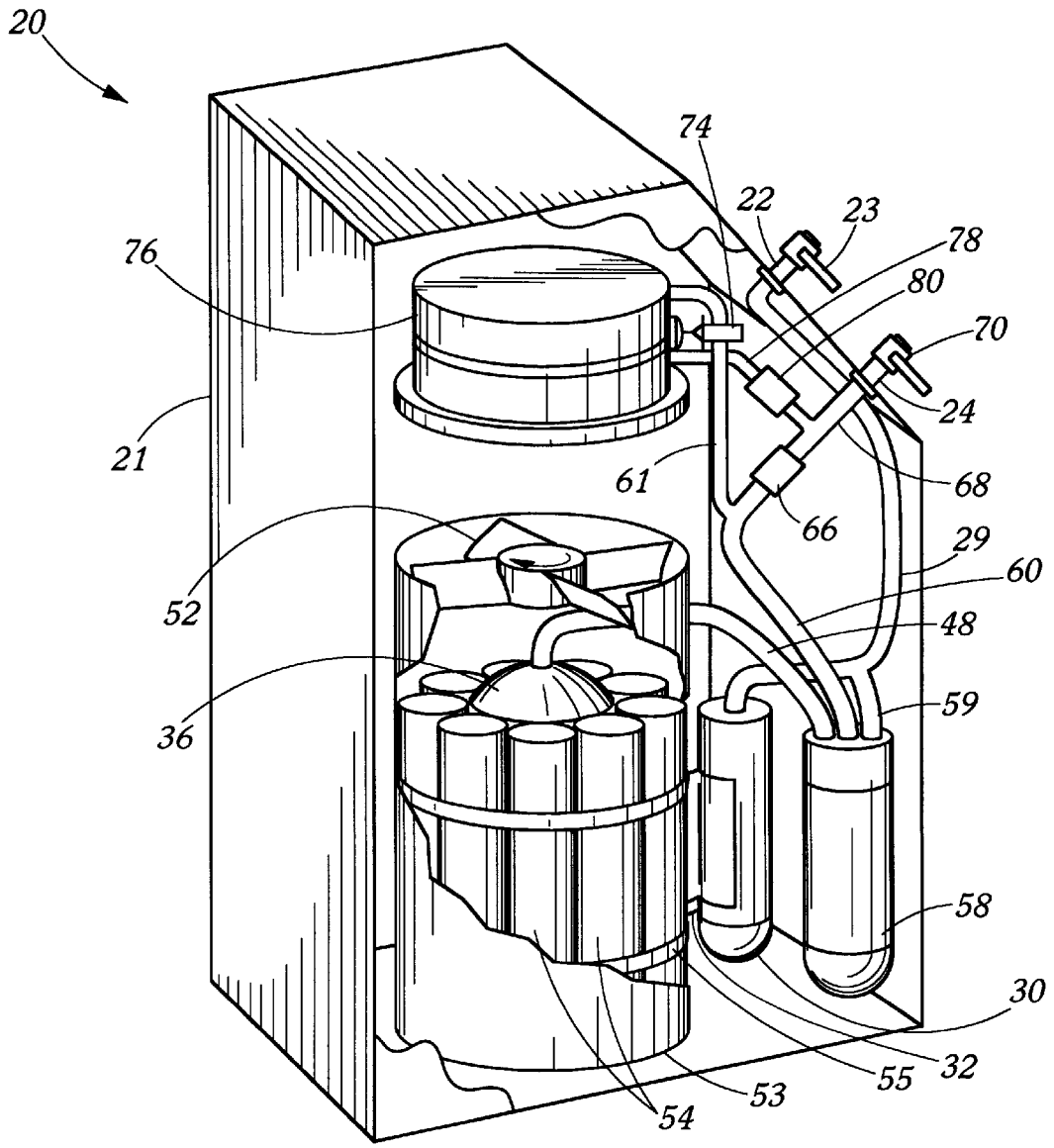
FIG. 4 is a perspective view of the refrigerant vacuum pump of FIG. 1 with a cut away of the structural container of the vacuum pump to illustrate additional components of the vacuum pump.
Figure 5:
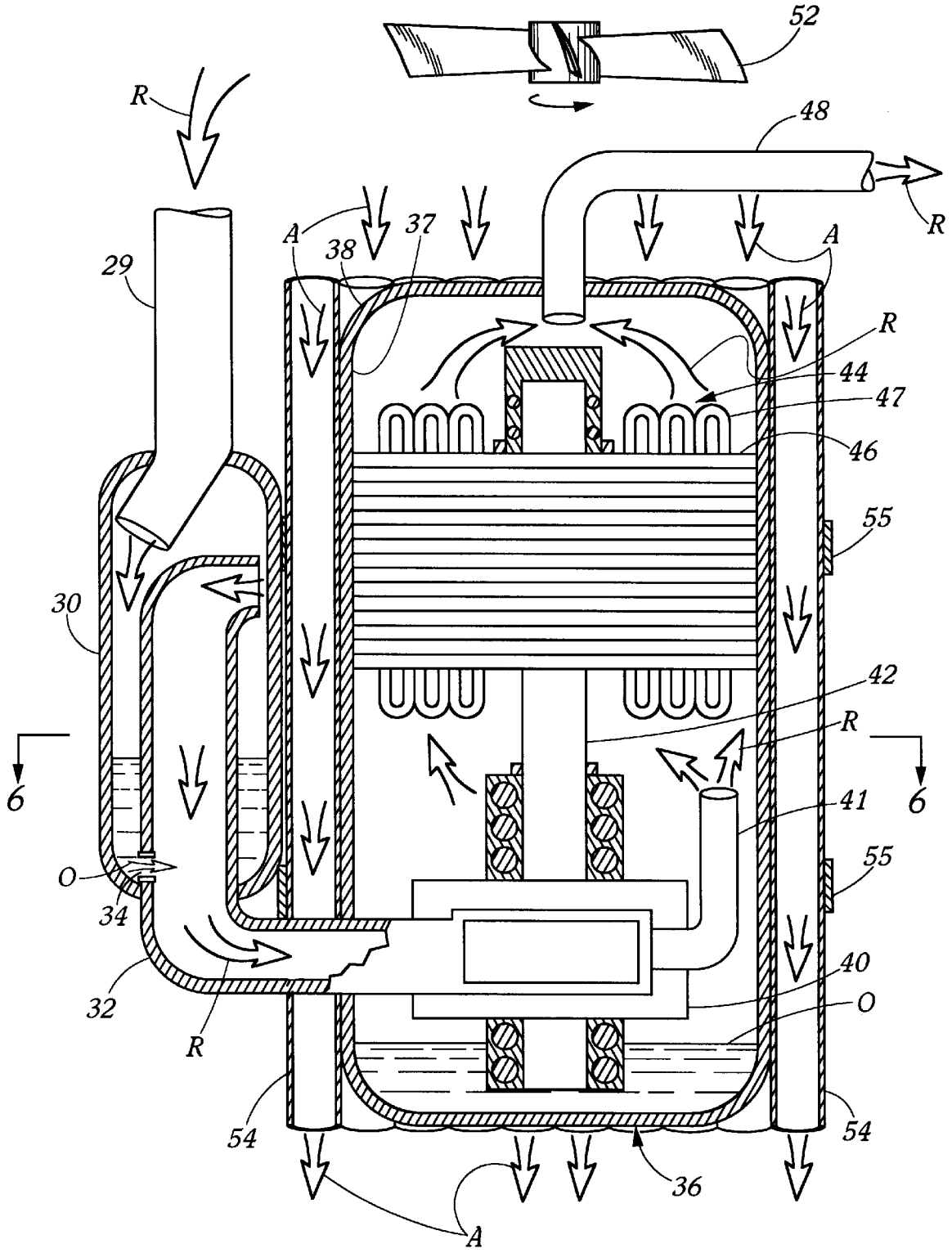
FIG. 5 is a partial sectional view of the compressor with the external cooling system of the vacuum pump of FIG. 4 to illustrate internal components and flow of refrigerant and cooling air.
Figure 6:
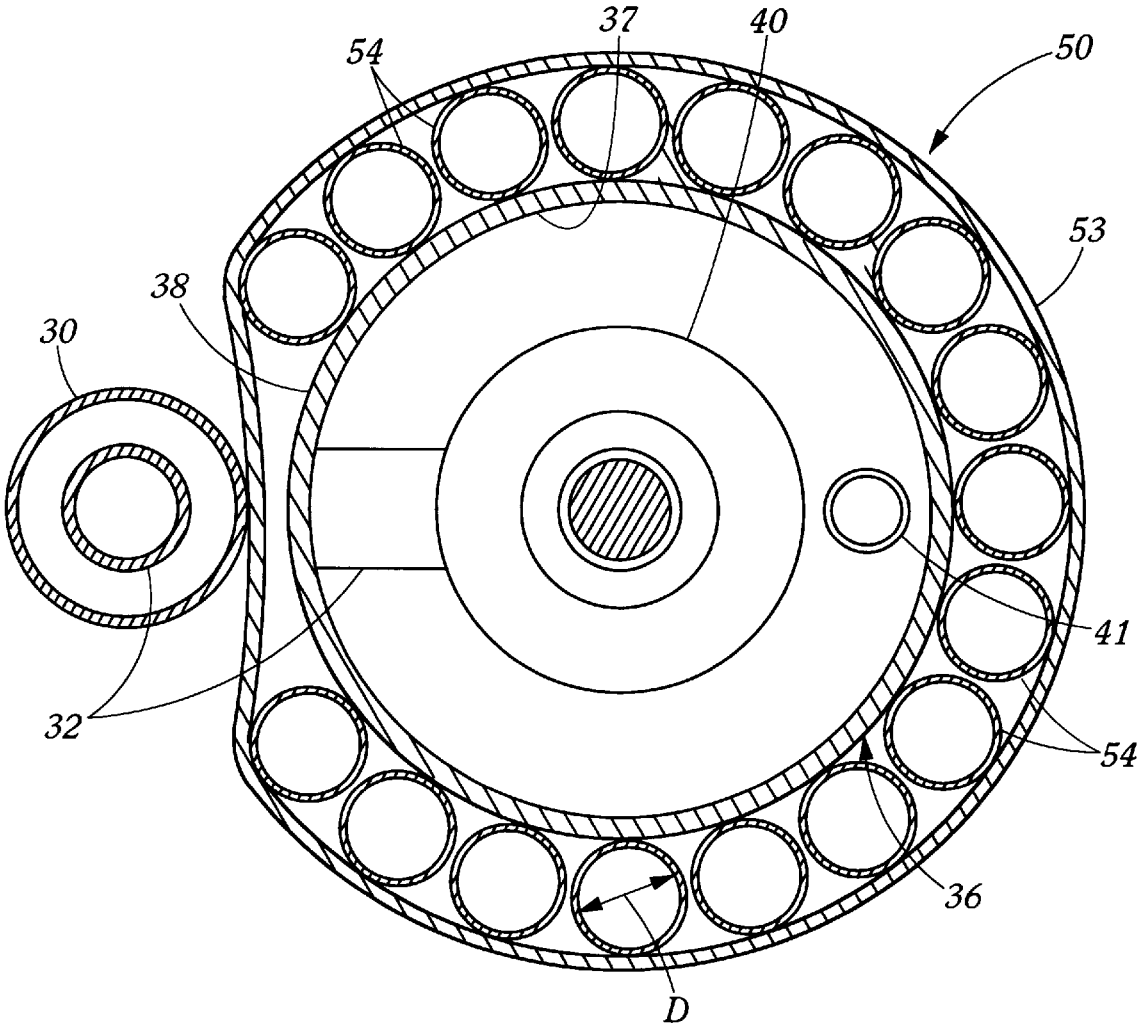
FIG. 6 is a sectional view of the compressor and external cooling system of FIG. 5 taken at line 6—6.

Referring now to FIGS. 4–6, the vacuum pump 20 and, more particularly, its unique method of cooling during extended periods of low refrigerant flow rates will be discussed in fuirther detail. FIG. 4 is a cutaway, perspective view showing one physical arrangement of the major components of the vacuum pump 20. The vacuum pump 20 can readily be contained in a single structural container 21. Clearly, a large number of configurations can be used, with the physical layout shown being provided as one preferred embodiment of the housing 36, suction accumulator 32, oil separator 58, second compressor 76, and associated conduits, valves, and accessories.

To provide cooling of the electric motor 44, the vacuum pump 20 includes an external cooling system 50. The external cooling system 50 functions to remove heat that builds up within the housing 36, especially due to operation of the electric motor 44 and compressor 40, that cannot be removed by the refrigerant, R, under deep vacuum, evacuation operations (e.g., operations with inlet pressures below atmospheric and usually less than about 4 inches Hg vacuum). The refrigerant, R, enters the suction accumulator through accumulator inlet conduit 29. Liquid refrigerant is vaporized and is drawn (by action of the compressor 40) into the compressor inlet conduit 32. Oil, O, is returned to the compressor 40 through oil return orifice 34. Refrigerant, R, exits the compressor 40 where it flows over the motor stator 46 and windings 47 of the electric motor 44. Refrigerant, R, then exits the housing 36 through the conduit 48. As noted above, however, the refrigerant flow becomes too low to remove enough heat from the housing 36 to prevent damage to the electric motor 44 and/or compressor 40 due to overheating.

To address this overheating problem, the external cooling system 50 includes a fan 52 to force air (or other gas) over the exterior portions of the housing 36, and the fan 52 can readily be operated to force flow toward the housing 36 or as a suction fan drawing air over the housing 36. Cooling is achieved in this manner because the electric motor 44 is preferably press fit or otherwise positioned within the housing 36 such that the stator 46 or other portions of the motor 44 are in contact with an inner surface 37 of the housing 36. In this regard, the housing 36 and the portion of the motor 44 in abutting contact are preferably fabricated from thermally conductive materials such as copper, steel, and other metals, to provide a heat transfer path with a relatively high thermal transfer rate to allow heat to flow easily from higher to lower temperatures points on the heat transfer path. Press fitting of the stator 46 is preferable for providing a larger heat transfer surface area between the motor 44 and the housing 36. During operations, heat built up within the stator 44 is quickly transferred from the stator 46 to the inner surface 37 through the housing 36 wall to an outer surface 38 of the housing 36. Although other heat build up in the housing 36 is transferred to the inner surface 37, this process is much slower due to the limited mass flow of refrigerant within the housing 36. Therefore, the inventor has found the direct, heat conductive contact between the stator 46 and the inner surface 37 of the housing 36 to be beneficial for quickly dissipating heat from the housing 36.

To dissipate the heat that reaches the outer surface 38 of the housing 36, the external cooling system 50 includes a heat transfer element that functions to provide an extended heat transfer surface for contacting and exchanging heat with the air, A, flowing from the fan 52. As illustrated, the heat transfer element includes a plurality of fins 54 that are positioned circumferentially about the housing 36 to provide a significantly large heat transfer surface for contacting and directing the flow of the cooling air, A, into the fins 54 from the outlet of the fan 52. The fins 54 could take a large number of shapes (flat or corrugated fins radiating out from the housing 36, tubes having myriad shapes such as oval, flat, and polygonal tubes) and sizes. The important feature is that the fins 54 provide enough heat transfer area relative to the size of the housing 36 and included motor 44 and compressor 40 (the main components for building up heat). In this regard, the fins 54 are illustrated as tubes having a diameter, D, which is less than about 2 inches (but, of course, in other embodiments the diameter could be selected from a large range such as ½ to 4 inches or larger). The fins 54 in the illustrated embodiment are fabricated from a standard schedule, copper tubing (although other heat conductive materials can be used). This size copper tubing has been found effective for a standard, high-side dome, rotary compressor in removing heat during evacuation operations. For example, but not limited to, any well-known rotary compressor with a rating of about 10,000 BTUH to 27,000 BTUH and higher, such as those used in window-type air conditioning units, could be used for the compressor 40, and in one embodiment, a 12,700 BTUH rotary compressor manufactured by Matsushita with a Serial No. P19U31145738 has been found to be effective for practicing the invention. Referring to FIGS. 5 and 6, heat from the motor stator 46 is transferred to the outer surface 38 of the housing 36 where the heat travels into the metal fins 54. The fan 52 blows cooling air, A, through the fins 54, and heat is transferred from the higher temperature surfaces of the fins 54 to the air, A, which flows out of the bottom of the cooling system 50, thereby effectively dissipating any heat from the outer surface 38 and the fins 54.

To facilitate fabrication, the fins 54 are mechanically forced into contact with the outer surface 38 of the housing 36 and with abutting contact with adjacent fins 54 with bands 55. Mechanical attachment is preferred for ease of construction and to avoid damaging the motor stator 46 during welding or other attachment processes. To improve air flow and protect the fins 54, an outer shell 53 is provided that encloses the fan 52, the fins 54 and the housing 36. With the shell 53 in place, air, A, from the fan 52 flows down the center of the tubular fins 54 and also on the outside surfaces of the fins 54 in gaps between the outer surface 38 of the housing 36 and between the fins 54 and the shell 53.

With an understanding of the operation of the vacuum pump 20 of the present invention, it will be understood that the external, supplemental cooling features of the vacuum pump 20 make it useful in numerous refrigerant evacuation systems in addition to the embodiment illustrated in FIGS. 1–3C. For example, any number of refrigerant handling devices can be used to replace the devices shown in FIG. 3A–3C, such as any type of refrigerant recovery, a recycling, and/or alternative reclaim machine. The final configuration of the evacuation system 10 is determined by the amount of processing of the evacuated refrigerant desired and with the requirement that each of these machines is configured to achieve such desired processing.

Figure 7:
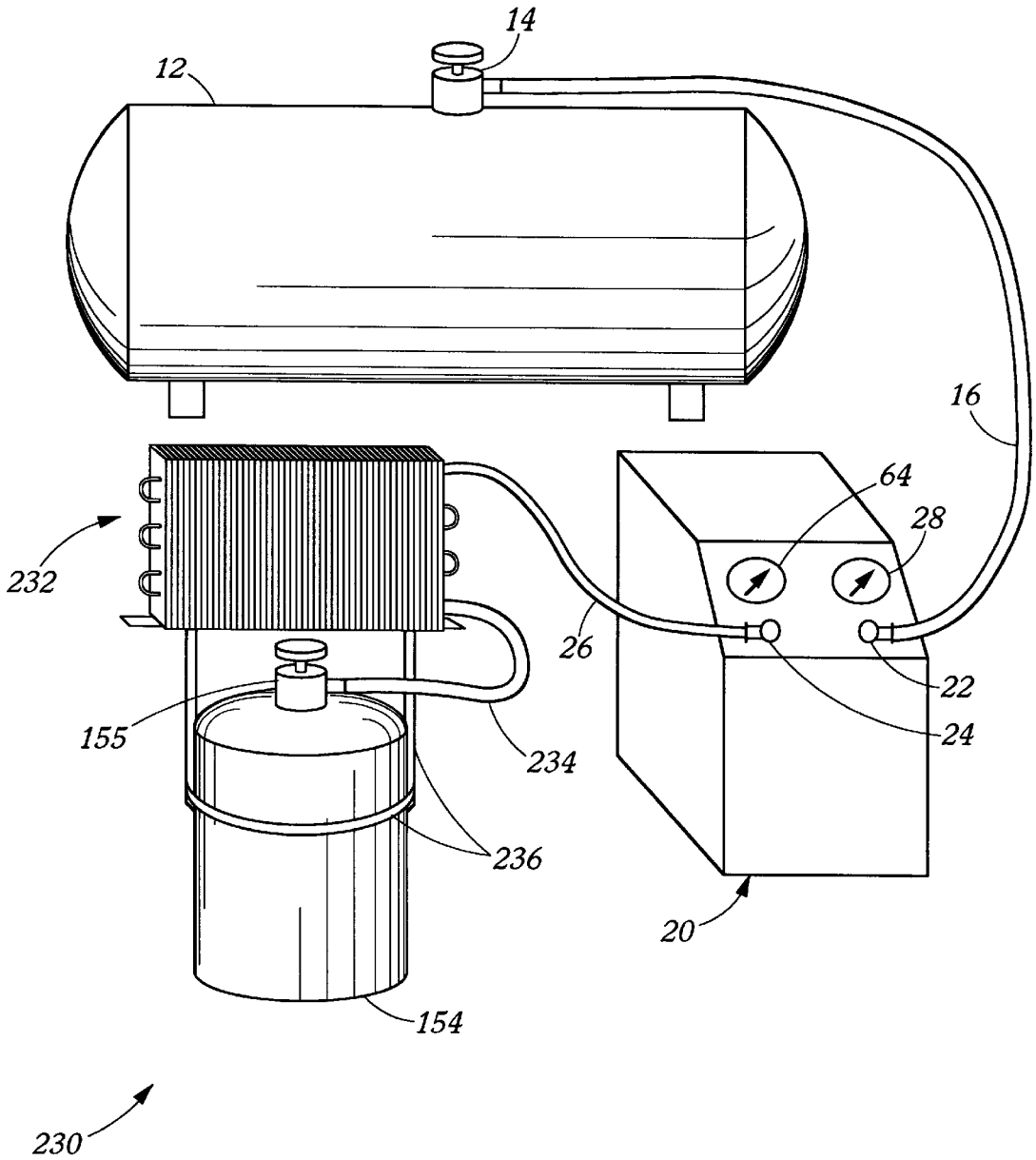
FIG. 7 is a perspective view of an embodiment of a refrigerant evacuation system in which refrigerant is evacuated from a storage tank by the vacuum pump of the present invention and through a condenser where gaseous refrigerant is liquified for storage in a cylinder.

Alternatively, referring to FIG. 7, an evacuation system 230 is illustrated generally including a storage tank 12 in fluid communication, via outlet 14 and suction conduit 16, with vacuum pump 20. In contrast to the evacuation system 10, refrigerant vacuum pump 20 discharges evacuated refrigerant through pump discharge conduit 26 into a refrigerant condenser 232 rather than into a reclaim machine 90. The condenser 232 may be any of a number of well-known condenser designs, such as a standard air condenser with a fan (not shown), capable of condensing the evacuated refrigerant into a liquid. The liquid refrigerant flows by gravity feed (although a liquid pump could be used) into refrigerant storage device 154 through inlet 155. In this manner, the evacuation system 230 provides a method of storing a large quantity of refrigerant with the same size refrigerant storage container 154.

Figure 8:
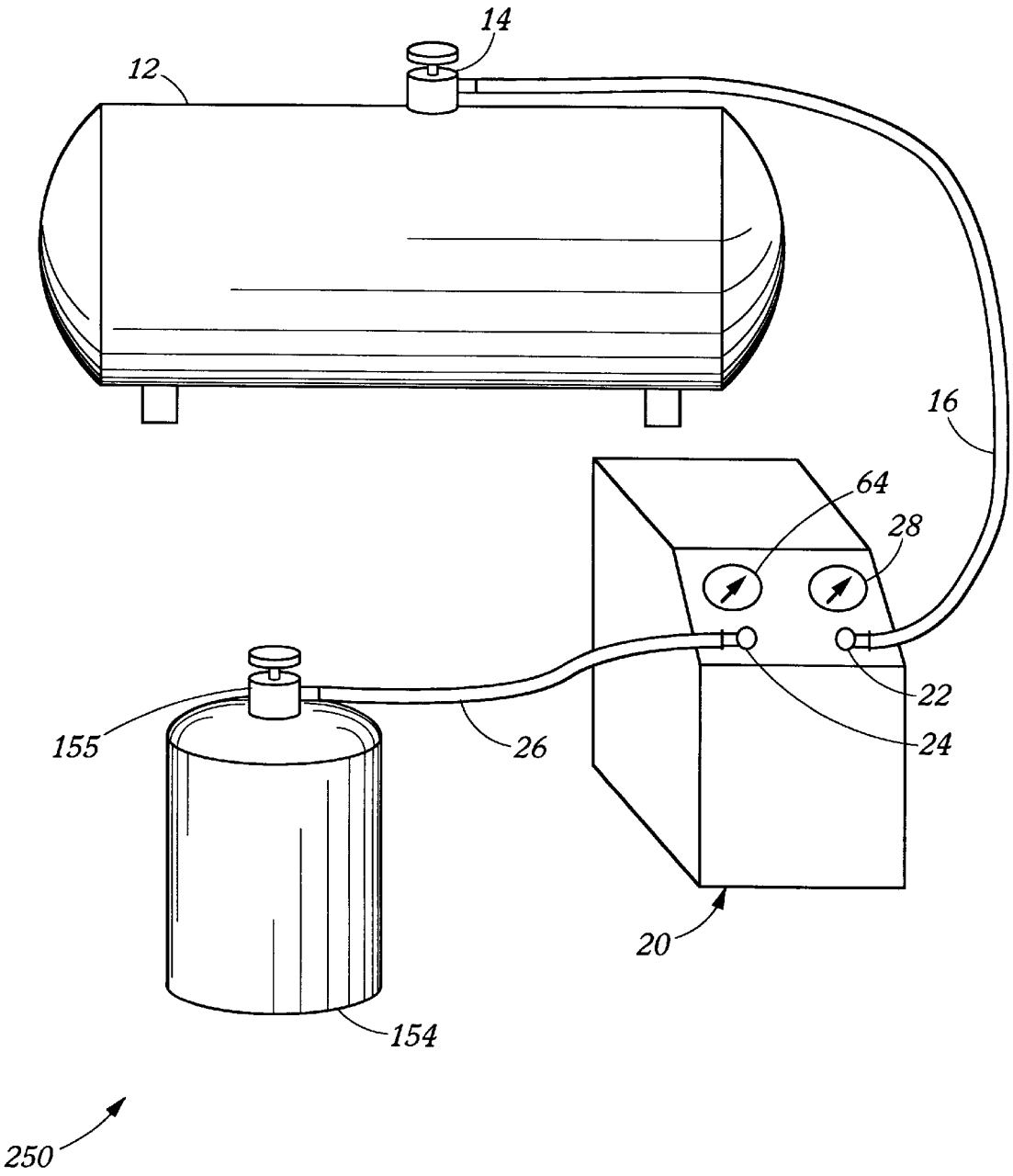
FIG. 8 is a perspective view of an embodiment of a refrigerant evacuation system in which refrigerant is evacuated from a storage tank by the vacuum pump of the present invention and pumped directly into a cylinder for storage under positive pressure.

Turning to FIG. 8, an evacuation system 250 is illustrated that is similar to evacuation system 230 except that the condenser 232 is removed. In this embodiment, gaseous refrigerant is pumped directly from the vacuum pump 20 into refrigerant storage device 154 via inlet 155. This embodiment illustrates the usefulness of the vacuum pump 20 in evacuating a storage tank 12 directly into a storage device 154 under pressure. In other words, the outlet 24 of the vacuum pump 20 is under a positive pressure as measured with outlet pressure gauge 64. Prior to this invention, this type of evacuation system was not possible as standard vacuum pumps cannot operate with any significant outlet pressure.

Although a number of modes of operation will be apparent to those skilled in the art, one preferred mode of operating the vacuum pump 20 will now be presented with reference to the evacuation system 250 with reference to FIGS. 2, 4–6, and 8. In this mode of operation, the vacuum pump 20 is initially connected to the refrigerant outlet 14 of the storage tank 12. Fluid communication is provided with suction conduit 16 which is connected to the inlet 22 of the vacuum pump 20. The initial pressure of the storage tank 12 can be a positive pressure as measured by suction pressure gauge 28, thereby eliminating the step of using a recovery or other refrigerant machine with a low-side dome compressor to bring the storage tank 12 pressure to atmospheric pressure or vacuum.

The outlet 24 of the vacuum pump 20 is connected to the inlet 155 of the storage device 154 and outlet control valve 70 is opened to provide a fluid path for evacuated refrigerant from the storage tank 12 through the vacuum pump 20 to the storage device 154. At this point and during evacuation, the solenoid valve 72 will be shut to prevent flow in conduit 61 to the second refrigerant compressor 76. To begin evacuation, the motor 44 is operated to drive the compressor 40 and refrigerant is pumped through the vacuum pump 20, as discussed above. To provide cooling, the external cooling system 50 is operated by running the fan 52 at least partially concurrently with operation of the motor 44. In one embodiment, the control wiring for the vacuum pump 20 is configured such that the motor 44 and the fan 52 are both turned on and off by the same switch (not shown) located on an exterior portion of the structural container 21. Alternatively, the fan 52 may be controlled such that it is turned on and off when in response to the outer surface 38 of the housing 36 reaching a predetermined temperature, to a low flow rate of refrigerant through the accumulator inlet conduit 29 (measured by flow or inlet pressure), and/or to another criterion that protects the motor 44 from overheating.

With the effective cooling provided by the external cooling system 50, the vacuum pump 20 can be started by a technician and simply left to operate, i.e., there is no need for continuous monitoring. The technician can monitor the inlet pressure of the vacuum pump 20 on suction pressure gauge 28 and shut the motor 44 (and fan 52) off when the inlet pressure reaches a predetermined evacuation level, such as 4 to 15 inches Hg vacuum as established by the EPA for evacuation of certain refrigerant devices. More preferably, a much lower evacuation level such as about 20 to about 30 inches Hg vacuum will be used by the technician to fully evacuate the storage tank 12. Clearly, the vacuum pump 20 can be adapted such that the technician can set the evacuation level desired and then leave the evacuation system 250 unmonitored. In this embodiment of vacuum pump 20 controls, the motor 44 and fan 52 operates until the set evacuation level is achieved, and then are automatically shut off. Alternatively, the motor 44 and fan 52 can be shut off manually. Significantly, the gaseous refrigerant in storage device 154 is under pressure and this pressure increases during the operation of the vacuum pump 20 to evacuate refrigerant from the storage device 12. In the above manner, the vacuum pump 20 can be operated to fully evacuate a storage tank 12 with an initial positive pressure to a very deep vacuum and store evacuated refrigerant directly into a storage device 154 that is also pressurized.

To clear the vacuum pump 20 of refrigerant, the solenoid valve 72 is opened and the compressor 76 is run (both of which can be automatically controlled/tied to shutting off the motor 44 and fan 52 or by manual selection of a self-clearing switch (not shown)). The compressor 76 is run for a relatively short period of time to pump any refrigerant that may remain in the components of the vacuum pump 20 to avoid having to connect a standard vacuum pump to the vacuum pump 20 and discharging refrigerant to atmosphere. Of course, the length of time that the compressor 76 needs to be run to obtain clearing varies with the size and configuration of the components of the vacuum pump 20. Once self-clearing is completed, the compressor 76 is shut down and the solenoid 72 is closed. The inlet 22 and the outlet control valve 70 are then closed to seal the vacuum pump 20 for future uses, and the storage tank 12 and storage device 154 are also closed and sealed.

Since numerous modifications and combinations of the above method and embodiments will readily occur to those skilled in the art, it is not desired to limit the invention to the exact construction and process shown and described above. For example, a number of methods other than the forced air system described above can be implemented to dissipate heat built up on the outer compressor shell, such as refrigerant or other fluid tubing coiled around the shell and the use of fluid flowing over the shell in direct contact with the shell's outer surfaces. Accordingly, resort may be made to all suitable modifications and equivalents that fall within the scope of the invention as defined by the claims which follow. The words "comprise," "comprises," "comprising," "include," "including," and "includes" when used in this specification and in the following claims are intended to specify the presence of stated features or steps, but they do not preclude the presence or addition of one or more other features, steps, or groups thereof.

What is claimed is:

1. A refrigerant vacuum pump with improved cooling for pumping refrigerant from a refrigerant device containing refrigerant to a predetermined evacuation pressure level within the refrigerant device, said vacuum pump comprising:

(a) a sealable housing fabricated from thermally conductive material, said housing having a refrigerant inlet for receiving refrigerant from the refrigerant device at an inlet pressure;

(b) a refrigerant compressor positioned within said housing and connected to said refrigerant inlet;

(c) an electric motor for driving said refrigerant compressor positioned within said housing with a portion of said electric motor contacting an inner surface of said housing to provide a heat transfer path between said electric motor and an outer surface of said housing;

(d) a cooling system external to said housing adapted for dissipating heat transferred from said electric motor to said heat transfer path, said cooling system being in heat-conductive contact with said outer surface of said housing;

(e) wherein said cooling system includes a heat transfer element positioned along the periphery of said housing and in heat-conductive contact with said outer surface of said housing and a fan to force a cooling gas to flow over said heat transfer element;

(f) wherein said heat transfer element comprises a plurality of fins fabricated from thermally conductive material; said fins are tubes being selected from the group of round, oval, and flat tubes.

2. The vacuum pump of claim 1, wherein the evacuation pressure level is in the range of about 0 inches of Hg vacuum to about 15 inches of Hg vacuum.

3. The vacuum pump of claim 1, wherein the evacuation pressure level is in the range of about 15 inches of Hg vacuum to 29.9 inches of Hg vacuum.

4. The vacuum pump of claim 1, wherein said refrigerant compressor is a rotating-vane rotary compressor.

5. The vacuum pump of claim 1, wherein the inlet pressure to said housing is greater than atmospheric pressure.

6. The vacuum pump of claim 5, wherein the housing includes a refrigerant outlet for discharging refrigerant from said housing at an outlet pressure, the outlet pressure being greater than atmospheric pressure.

7. The vacuum pump of claim 1, further including a suction accumulator between the refrigerant device and said refrigerant inlet of said housing configured to prevent any liquid refrigerant from entering said refrigerant compressor.

8. The vacuum pump of claim 7, further including an oil separator for receiving refrigerant discharged from said housing and separating out oil contained in the received refrigerant, said oil separator being connected with an oil return line to said suction accumulator and said suction accumulator including a means for injecting said captured oil into vaporized refrigerant in said suction accumulator.

9. The vacuum pump of claim 8, further including a second refrigerant compressor in fluid communication with said oil separator for drawing refrigerant from said oil separator and pumping refrigerant through an outlet of said vacuum pump to clear said vacuum pump of refrigerant.

10. An evacuation system for removing refrigerant from a device containing refrigerant, said evacuation system comprising:

a vacuum pump connected to an outlet of the refrigerant device, said vacuum pump including:

a sealable housing having a refrigerant inlet connected to the refrigerant device;

a refrigerant compressor positioned within said housing and connected to said refrigerant inlet to draw refrigerant out of the refrigerant device to achieve a predetermined evacuation pressure level;

an electric motor for driving said refrigerant compressor positioned within said housing with a portion of said electric motor contacting an inner surface of said housing; and a cooling means external to said housing for dissipating heat from an outer surface of said housing; and a storage device in fluid communication with said vacuum pump for receiving and storing refrigerant discharged from said vacuum pump.

11. The evacuation system of claim 10, further including a refrigerant reclaim machine connected to an outlet of said vacuum pump and an inlet of said storage device.

12. The evacuation system of claim 10, further including a refrigerant recovery machine connected to an outlet of said vacuum pump and an inlet of said storage device.

13. The evacuation system of claim 10, further including a refrigerant recycling machine in fluid communication with an outlet of said vacuum pump for receiving and processing gaseous refrigerant discharged from said vacuum pump and in fluid communication with an inlet of said storage container.

14. The evacuation system of claim 10, further including a condenser in fluid communication with an outlet of said vacuum pump for receiving and condensing gaseous refrigerant discharged from said vacuum pump to liquid refrigerant and in fluid communication with an inlet of said storage container.

15. The evacuation system of claim 10, wherein the evacuation pressure level is in the range of about 0 inches of Hg vacuum to about 15 inches of Hg vacuum.

16. The evacuation system of claim 10, wherein the evacuation pressure level is in the range of about 15 inches of Hg vacuum to 29.9 inches of Hg vacuum.

17. The evacuation system of claim 10, wherein said cooling means includes a heat transfer element positioned along the periphery of said housing and in heat-conductive contact with said outer surface of said housing and a fan to force a cooling gas to flow over said heat transfer element.

18. The vacuum pump of claim 17, wherein said heat transfer element comprises a plurality of fins fabricated from thermally conductive material.

19. The vacuum pump of claim 18, wherein said fins are tubes having a diameter of less than about 2 inches.

20. The vacuum pump of claim 10, wherein pressure of refrigerant in the refrigerant device is greater than atmospheric pressure when said vacuum pump is initially connected to an outlet of the refrigerant device.

21. A method for evacuating a refrigerant-containing device to an evacuation pressure level, comprising:

(a) connecting a vacuum pump to a refrigerant outlet of the device, said vacuum pump including a housing having a refrigerant inlet for receiving refrigerant from the refrigerant device, a refrigerant compressor positioned within said housing and connected to said refrigerant inlet, an electric motor for driving said refrigerant compressor positioned within said housing with a portion of said electric motor contacting an inner surface of said housing, and a cooling system external to said housing, said cooling system being in heat-conductive contact with said outer surface of said housing;

(c) operating said vacuum pump to pump refrigerant from the device;

(d) using, at least partially contemporaneously with said operating, said cooling system to dissipate heat from an outer surface of said housing; and (e) measuring initial pressure of refrigerant in the device, said initial pressure being greater than about atmospheric pressure.

22. A method for evacuating a refrigerant-containing device to an evacuation pressure level, comprising:

(a) connecting a vacuum pump to a refrigerant outlet of the device, said vacuum pump including a housing having a refrigerant inlet for receiving refrigerant from the refrigerant device, a refrigerant compressor positioned within said housing and connected to said refrigerant inlet, an electric motor for driving said refrigerant compressor positioned within said housing with a portion of said electric motor contacting an inner surface of said housing, and a cooling system external to said housing, said cooling system being in heat-conductive contact with said outer surface of said housing;

(b) operating said vacuum pump to pump refrigerant from the device;

(c) using, at least partially contemporaneously with said operating, said cooling system to dissipate heat from an outer surface of said housing; and (d) measuring, concurrently with said operating said vacuum pump, pressure of refrigerant in the device and ending said operating said vacuum pump and said using said cooling system when said measured pressure of the refrigerant in the device is a vacuum pressure greater than the evacuation pressure level.

23. The method of claim 22, wherein said evacuation pressure level is in the range of about 4 inches of Hg vacuum to 29.9 inches of Hg vacuum.

24. A method for evacuating a refrigerant-containing device to an evacuation pressure level, comprising:

(a) connecting a vacuum pump to a refrigerant outlet of the device, said vacuum pump including a housing having a refrigerant inlet for receiving refrigerant from the refrigerant device, a refrigerant compressor positioned within said housing and connected to said refrigerant inlet, an electric motor for driving said refrigerant compressor positioned within said housing with a portion of said electric motor contacting an inner surface of said housing, and a cooling system external to said housing, said cooling system being in heat-conductive contact with said outer surface of said housing;

(b) operating said vacuum pump to pump refrigerant from the device;

(c) using, at least partially contemporaneously with said operating, said cooling system to dissipate heat from an outer surface of said housing;

(d) wherein said cooling system includes a heat transfer element positioned along the periphery of said housing and in heat-conductive contact with said outer surface of said housing and a fan to force a cooling gas to flow over said heat transfer element;

(e) wherein said heat transfer element comprises a plurality of fins fabricated from thermally conductive material;

(f) wherein said fins are tubes being selected from the group of round, oval, and flat tubes.

25. A method for evacuating a refrigerant-containing device to an evacuation pressure level, comprising:

(a) connecting a vacuum pump to a refrigerant outlet of the device, said vacuum pump including a housing having a refrigerant inlet for receiving refrigerant from the refrigerant device, a refrigerant compressor positioned within said housing and connected to said refrigerant inlet, an electric motor for driving said refrigerant compressor positioned within said housing with a portion of said electric motor contacting an inner surface of said housing, and a cooling system external to said housing, said cooling system being in heat-conductive contact with said outer surface of said housing;

(b) operating said vacuum pump to pump refrigerant from the device;

(c) using, at least partially contemporaneously with said operating, said cooling system to dissipate heat from an outer surface of said housing;

(d) wherein said vacuum pump includes a second refrigerant compressor in fluid communication with said housing and further including clearing said vacuum pump of refrigerant by operating said second refrigerant compressor to pump refrigerant from said vacuum pump.

* * * * *